US009913036B2

(12) United States Patent
Stoecklmeier et al.

(10) Patent No.: US 9,913,036 B2
(45) Date of Patent: Mar. 6, 2018

(54) APPARATUS AND METHOD AND COMPUTER PROGRAM FOR GENERATING A STEREO OUTPUT SIGNAL FOR PROVIDING ADDITIONAL OUTPUT CHANNELS

(71) Applicant: FRAUNHOFER-GESELLSCHAFT ZUR FOERDERUNG DER ANGEWANDTEN FORSCHUNG E.V., Munich (DE)

(72) Inventors: Christian Stoecklmeier, Spardorf (DE); Stefan Finauer, Munich (DE); Christian Uhle, Nuremberg (DE); Peter Prokein, Erlangen (DE); Oliver Hellmuth, Erlangen (DE); Ulrik Heise, Vienna (DE)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 19 days.

(21) Appl. No.: 14/078,433

(22) Filed: Nov. 12, 2013

(65) Prior Publication Data

US 2014/0072124 A1 Mar. 13, 2014

Related U.S. Application Data

(63) Continuation of application No. PCT/EP2012/058435, filed on May 8, 2012.
(Continued)

(30) Foreign Application Priority Data

Jul. 7, 2011 (EP) ..... 11173101

(51) Int. Cl.
*H04R 5/00* (2006.01)
*H04S 1/00* (2006.01)
*H04S 5/00* (2006.01)

(52) U.S. Cl.
CPC ..... *H04R 5/00* (2013.01); *H04S 1/007* (2013.01); *H04S 5/005* (2013.01); *H04S 2400/05* (2013.01)

(58) Field of Classification Search
CPC ..... G10L 19/008; H04S 3/00; H04S 5/005; H04S 2400/01; H04S 7/30; H04S 2420/01; H04S 2420/03
(Continued)

(56) References Cited

U.S. PATENT DOCUMENTS 7,252,723 B2 8/2007 Dif et al.
7,257,231 B1 8/2007 Avendano et al.
(Continued)

FOREIGN PATENT DOCUMENTS

JP S62068129 5/1987
JP S63174000 11/1988
(Continued)

OTHER PUBLICATIONS

Schroeder, Manfred R. , "An Artificial Stereophonic Effect Obtained From Using a Single Signal", presented at the 9th annual AES meeting, Oct. 8-12, 1957, 1-17.

*Primary Examiner* — Alexander Jamal
(74) *Attorney, Agent, or Firm* — Perkins Coie LLP; Michael A. Glenn

(57) ABSTRACT

An apparatus for generating a stereo output signal includes a manipulation information generator being adapted to generate manipulation information depending on a first signal indication value of a first input channel and on a second signal indication value of a second input channel, and a
(Continued)

manipulator for manipulating a combination signal based on the manipulation information to obtain a first manipulated signal as a first output channel and a second manipulated signal as a second output channel. The combination signal is a signal derived by combining the first input channel and the second input channel. Furthermore, the manipulator is configured for manipulating the combination signal in a first manner, when the first signal indication value is in a first relation to the second signal indication value, or in a different second manner, when the first signal indication value is in a different second relation to the second signal indication value.

18 Claims, 10 Drawing Sheets

Related U.S. Application Data

(60) Provisional application No. 61/486,087, filed on May 13, 2011.

(58) Field of Classification Search
USPC ..... 381/27, 307, 23, 17
See application file for complete search history.

(56) References Cited

U.S. PATENT DOCUMENTS

| | | | | |
|---|---|---|---|---|
| 7,315,624 | B2 | 1/2008 | Avendano et al. | |
| 7,412,380 | B1 | 8/2008 | Avendano | |
| 7,567,845 | B1 | 7/2009 | Avendano | |
| 7,646,875 | B2 | 1/2010 | Myburg et al. | |
| 8,340,303 | B2 * | 12/2012 | Chun | H04S 7/30 381/17 |
| 2002/0037086 | A1 | 3/2002 | Irwan et al. | |
| 2005/0058304 | A1 * | 3/2005 | Baumgarte | G10L 19/008 381/98 |
| 2007/0041592 | A1 | 2/2007 | Avendano et al. | |
| 2008/0033732 | A1 * | 2/2008 | Seefeldt | G10L 19/008 704/500 |
| 2008/0154583 | A1 | 6/2008 | Goto et al. | |
| 2009/0022328 | A1 * | 1/2009 | Neugebauer | H04S 7/30 381/27 |
| 2009/0092258 | A1 | 4/2009 | Merimaa et al. | |
| 2009/0198356 | A1 | 8/2009 | Goodwin et al. | |
| 2014/0010375 | A1 * | 1/2014 | Usher | H04S 5/00 381/27 |
| 2014/0270281 | A1 * | 9/2014 | Walsh | H04S 3/02 381/300 |

FOREIGN PATENT DOCUMENTS

| | | | |
|---|---|---|---|
| JP | H0494300 | A | 3/1992 |
| JP | H06319199 | A | 11/1994 |
| JP | H07212896 | A | 8/1995 |
| JP | H10070796 | A | 3/1998 |
| JP | 2003511881 | A | 3/2003 |
| JP | 2006100869 | A | 4/2006 |
| JP | 2006203906 | A | 8/2006 |
| JP | 2007143103 | A | 6/2007 |
| RU | 2392671 | C2 | 6/2010 |
| TW | I359620 | | 10/1996 |
| TW | 569551 | | 1/2004 |
| TW | I313857 | | 4/2005 |
| TW | I309140 | | 7/2008 |
| WO | WO-2001/24577 | | 4/2001 |
| WO | WO-2003/028407 | | 4/2003 |
| WO | WO-2005/101371 | | 10/2005 |
| WO | WO-2007/026025 | | 3/2007 |
| WO | WO-2008/046530 | | 4/2008 |
| WO | 2009049895 | A1 | 4/2009 |
| WO | 2010073187 | A1 | 7/2010 |

* cited by examiner

APPARATUS AND METHOD AND COMPUTER PROGRAM FOR GENERATING A STEREO OUTPUT SIGNAL FOR PROVIDING ADDITIONAL OUTPUT CHANNELS

CROSS-REFERENCE TO RELATED APPLICATIONS

This application is a continuation of copending International Application No. PCT/EP2012/058435, filed May 8, 2012, which is incorporated herein by reference in its entirety, and additionally claims priority from U.S. Application No. 61/486,087, filed May 13, 2011, and European Application 11173101.4, filed Jul. 7, 2011, both of which are incorporated herein by reference in their entirety.

The present invention relates to audio processing and in particular to techniques for generating a stereo output signal.

BACKGROUND OF THE INVENTION

Audio processing has advanced in many ways. In particular, surround systems have become more and more important. However, most music recordings are still encoded and transmitted as a stereo signal and not as a multi-channel signal. As surround systems comprise a plurality of loudspeakers, e.g. four or five, it has been subject of many studies what signals to provide to which one of the loudspeakers, when there are only two input signals available. Providing the first input signal unaltered to a first group of loudspeakers and the second input signal unaltered to a second group would of course be a solution. But the listener would not really get the impression of real-life surround sound, but instead would hear the same sound from different speakers.

Moreover, consider a surround system comprising five loudspeakers including a center speaker. To provide the user a real-life sound-experience, sounds that in reality originate from a location in front of the listener should be reproduced by the front speakers and not by the left and right surround loudspeakers behind the listener. Therefore, audio signals should be available which do not comprise such sound portions.

Furthermore, listeners desiring to experience real-life surround sound also expect high-quality audio sound from the left and right surround loudspeakers. Providing both surround speakers with the same signal is not a desired solution. Sounds that originate from the left of the listener's location should not be reproduced by the right surround speaker and vice versa.

However, as already mentioned, most music recordings are still encoded as stereo signals. A lot of stereo music productions employ amplitude panning. Sound sources $s_k$ are recorded and are subsequently panned by applying weighting masks $a_k$ such that, in a stereo system, they appear to originate from a particular position between a left loudspeaker receiving a left stereo channel $x_L$ of a stereo input signal and a right loudspeaker receiving a right stereo channel $x_R$ of the stereo input signal. Moreover, such recordings comprise ambient signal portions $n_1$, $n_2$, originating, e.g., from room reverberation. Ambient signal portions appear in both channels, but do not relate to a particular sound source. Therefore, the left $x_L$ and the right $x_R$ channel of a stereo input signal may comprise:

$$x_L = \sum_k s_k + n_1$$

$$x_R = \sum_k a_k \cdot s_k + n_2$$

$x_L$: left stereo signal
$x_R$: right stereo signal
$a_k$: panning factor of sound source k
$s_k$: signal sound source k
$n_1$, $n_2$: ambient signal portions In surround systems, commonly, only some of the loudspeakers are assumed to be located in front of a listener's seat (for example, a center, a front left and a front right speaker), while other speakers are assumed to be located to the left and to the right behind a listener's seat (e.g., a left and a right surround speaker).

Signal components that are equally present in both channels of the stereo input signal ($s_k = a_k \cdot s_k$) appear to originate from a sound source at a center position in front of the listener. It may therefore be desirable, that these signals are not reproduced by the left and the right surround speaker behind the listener.

It may moreover be desirable that signal components that are mainly present in the left stereo channel ($s_k >> a_k \cdot s_k$) are reproduced by the left surround speaker; and that signal components that are mainly present in the right stereo channel ($s_k << a_k \cdot s_k$) are reproduced by the right surround speaker.

Moreover, it may furthermore be desirable, that ambient signal portion $n_1$ of the left stereo channel shall be reproduced by the left surround speaker while the ambient the signal portion $n_2$ of the right stereo channel shall be reproduced by the right surround speaker.

To provide the left and the right surround speaker with suitable signals, it would therefore be highly appreciated to provide at least two output channels from two channels of a stereo input signal which are different from the two input channels and which possess the described properties.

The desire for generating a stereo output signal from a stereo input signal is however not limited to surround systems, but may also be applied in traditional stereo systems. A stereo output signal might also be useful to provide a different sound experience, for example, a wider sound field for traditional stereo systems having two loudspeakers, e.g., by providing stereo-base widening. Regarding replay using stereo loudspeakers or earphones, a broader and/or enveloping audio impression may be generated.

According to a first method of conventional technology, a mono input source is processed to generate a stereo signal for playback, thus creating two channels from the mono input source. By this, an input signal is modified by complementary filters to generate a stereo output signal. When being replayed by two loudspeakers, the generated stereo signal creates a wider sound than the unfiltered replay of the same signal. However, the sound sources comprised in the stereo signal are "smeared", as no directional information is generated. Details are presented in:

Manfred Schroeder "An Artificial Stereophonic Effect Obtained From Using a Single Signal", presented at the $9^{th}$ annual AES meeting Oct. 8-12, 1957.

Another proposed approach is presented in WO 9215180 A1: "Sound reproduction systems having a matrix converter". According to this conventional technology, a stereo output signal is generated from a stereo input signal by applying a linear combination of the channels of the stereo input signal. By applying this method, output signals may be generated which significantly attenuate center-panned portions of the input signal. However, the method also results in a lot of crosstalk (from the left channel to the right channel and vice versa). Crosstalk may be reduced by limiting the influence of the right input signal to the left output signal and vice versa, in that the corresponding weighting factor of the linear combination is adjusted. This however, would also result in reduced attenuation of center-panned signal portions in the surround speakers. Signals, originating from a front-center location would unintentionally be reproduced by the rear surround speakers.

Another proposed concept of conventional technology is to determine direction and ambience of a stereo input signal in a frequency domain by applying complex signal analysis techniques. This concept of conventional technology is, e.g., presented in U.S. Pat. No. 7,257,231 B1, U.S. Pat. No. 7,412,380 B1 and U.S. Pat. No. 7,315,624 B2. According to this approach, both input signals are examined with respect to direction and ambience for each time-frequency bin and are repanned in a surround system depending on the result of the direction and ambience analysis. According to this approach, a correlation analysis is employed to determine ambient signal portions. Based on the analysis, surround channels are generated which comprise predominantly ambient signal portions and from which center-panned signal portions may be removed. However, as both directional analysis as well as ambience extraction is based on estimations which are not always free of errors, undesired artifacts may be generated. The problem of generated undesired artifacts increases, if an input signal mix comprises several signals (e.g., of different instruments) with superimposed spectra. An effective signal-dependent filtering may be used for removing center-panned portions from the stereo signal, which however makes estimation errors caused by "musical noise" clearly visible. Moreover, the combination of a direction analysis and ambience extraction furthermore results in an addition of artifacts from both methods.

SUMMARY

According to an embodiment, an apparatus for generating a stereo output signal having a first output channel and a second output channel from a stereo input signal having a first input channel and a second input channel may have: a manipulation information generator being adapted to generate manipulation information depending on a first signal indication value of the first input channel and on a second signal indication value of the second input channel; and a manipulator for manipulating a combination signal based on the manipulation information to acquire a first manipulated signal as the first output channel and a second manipulated signal as the second output channel; wherein the combination signal is a signal derived by combining the first input channel and the second input channel; and wherein the manipulator is configured for manipulating the combination signal in a first manner, when the first signal indication value is in a first relation to the second signal indication value, or in a different second manner, when the first signal indication value is in a different second relation to the second signal indication value.

According to another embodiment, an upmixer for generating at least three output channels from at least two input channels may have: an apparatus for generating a stereo output signal according to claim 1 being arranged to receive two of the input channels of the upmixer as input channels; and a combining unit for combining at least two of the input signals of the upmixer to provide a combination channel; wherein the upmixer is adapted to output the first output channel of the apparatus for generating a stereo output signal or a signal derived from the first output channel of the apparatus for generating a stereo output signal as a first output channel of the upmixer; wherein the upmixer is adapted to output the second output channel of the apparatus for generating a stereo output signal or a signal derived from the second output channel of the apparatus for generating a stereo output signal as a second output channel of the upmixer; and wherein the upmixer is adapted to output the combination channel as a third output channel of the upmixer.

According to another embodiment, an apparatus for stereo-base widening for generating two output channels from two input channels may have: an apparatus for generating a stereo output signal according to claim 1, being arranged to receive the two input channels of the apparatus for stereo-base widening as input channels; and a combining unit for combining at least one of the output channels of the apparatus for generating a stereo output signal with at least one of the input channels of the apparatus for stereo-base widening to provide a combination channel; wherein the apparatus for stereo-base widening is adapted to output the combination channel or a signal derived from the combination channel.

According to another embodiment, a method for generating a stereo output signal having a first output channel and a second output channel from a stereo input having a first input channel and a second input channel may have the steps of: generating manipulation information depending on a first signal indication value of the first input channel and on a second signal indication value of the second input channel; and manipulating a combination signal based on the manipulation information to acquire a first manipulated signal as the first output channel and a second manipulated signal as the second output channel; wherein the combination signal is derived by combining the first input channel and the second input channel; and wherein the manipulation of the combination signal is conducted by manipulating the combination signal in a first manner when the first signal indication value is in a first relation to the second signal indication value, or in a different second manner, when the first signal indication value is in a different second relation to the second signal indication value.

According to another embodiment, an apparatus for encoding manipulation information may have: a signal indication computing unit for determining a first signal indication value of a first channel of a stereo input signal and for determining a second signal indication value of a second channel of the stereo input signal; a manipulation information generator being adapted to generate manipulation information depending on a first signal indication value of the first input channel and on a second signal indication value of the second input channel; and an output module for outputting the manipulation information; wherein the manipulation information is suitable for manipulating a combination signal based on the manipulation information to generate a first channel and a second channel of a stereo output signal; wherein the combination signal is a signal derived by combining the first input channel and the second input channel; and wherein the manipulation information indicates a relation of the first signal indication value to the second signal indication value; and wherein the relation of the first signal indication value to the second signal indication value indicates that the combination signal should be manipulated in a first manner to generate the stereo output signal, when the first signal indication value is in a first relation to the second signal indication value, or that the combination signal should be manipulated in a second different manner to generate the stereo output signal, when the first signal indication value is in a second different relation to the second signal indication value.

Another embodiment may have a computer program for generating a stereo output signal having a first and a second output channel from a stereo input signal having a first input channel and a second input channel, implementing a method according to claim 16.

According to the present invention, an apparatus for generating a stereo output signal is provided. The apparatus generates a stereo output signal having a first output channel and a second output channel from a stereo input signal having a first input channel and a second input channel.

The apparatus may comprise a manipulation information generator which is adapted to generate manipulation information depending on a first signal indication value of the first input channel and on a second signal indication value of the second input channel. Furthermore, the apparatus comprises a manipulator for manipulating a combination signal based on the manipulation information to obtain a first manipulated signal as the first output channel and a second manipulated signal as the second output channel.

The combination signal is a signal derived by combining the first input channel and the second input channel. Moreover, the manipulator might be configured for manipulating the combination signal in a first manner, when the first signal indication value is in a first relation to the second signal indication value, or in a different second manner, when the first signal indication value is in a different second relation to the second signal indication value.

The stereo output signal is therefore generated by manipulating a combination signal. As the combination signal is derived by combining the first and the second input channels and thus contains information about both stereo input channels, the combination signal is a suitable basis for generating a stereo output signal from two the input channels.

In an embodiment, the manipulation information generator is adapted to generate manipulation information depending on a first energy value as the first signal indication value of the first input channel and on a second energy value as the second signal indication value of the second input channel. Furthermore, the manipulator is configured for manipulating the combination signal in a first manner when the first energy value is in a first relation to the second energy value, or in a different second manner, when the first energy value is in a different second relation to the second energy value. In such an embodiment, energy values of the first and the second input channel are used as manipulation information. The energies of the two input channel provide a suitable indication on how to manipulate a combination signal to obtain the first and the second output channel, as they contain significant information about the first and the second input channel.

In another embodiment the apparatus furthermore comprises a signal indication computing unit to calculate the first and the second signal indication value.

In another embodiment, the manipulator is adapted to manipulate the combination signal, wherein the combination signal represents a difference between the first and the second input channel. This embodiment is based on the finding that employing a difference signal provides significant advantages.

According to a further embodiment, the apparatus comprises a transformer unit for transforming the first and second input channel from a time domain into a frequency domain. This allows frequency dependent processing of signal sources.

Moreover, an apparatus according to an embodiment may be adapted to generate a first weighting mask depending on the first signal indication value and a second weighting mask depending on the second signal indication value. The apparatus may be adapted to manipulate the combination signal by applying the first weighting mask to an amplitude value of the combination signal to obtain a first modified amplitude value, and may be adapted to manipulate the combination signal by applying the second weighting mask to an amplitude value of the combination signal to obtain a second modified amplitude value. The first and second weighting mask provide an effective way to modify the difference signal based on the first and second input signal.

In a further embodiment, the apparatus comprises a combiner which is adapted to combine the first amplitude value and a phase value of the combination signal to obtain the first output channel, and to combine the second amplitude value and a phase value of the combination signal to obtain the second output channel. In such an embodiment, the phase value of the combination signal is left unchanged.

According to another embodiment, a first and/or a second weighting mask are generated by determining a relation between a signal indication value of the first channel and a signal indication value of the second channel. A tuning parameter may be employed.

According to a further embodiment, a transformer unit and a combination signal generator are provided. In this embodiment, the input signals are transformed into a frequency domain before a combination signal is generated. Transforming the combination signal into a frequency domain is thus avoided which saves processing time.

Furthermore, an upmixer, an apparatus for stereo-base widening, a method for generating a stereo output signal, an apparatus for encoding manipulation information and a computer program for generating a stereo output signal are provided.

BRIEF DESCRIPTION OF THE DRAWINGS

Embodiments of the present invention will be detailed subsequently referring to the appended drawings, in which.

DETAILED DESCRIPTION OF THE INVENTION

Figure 1:
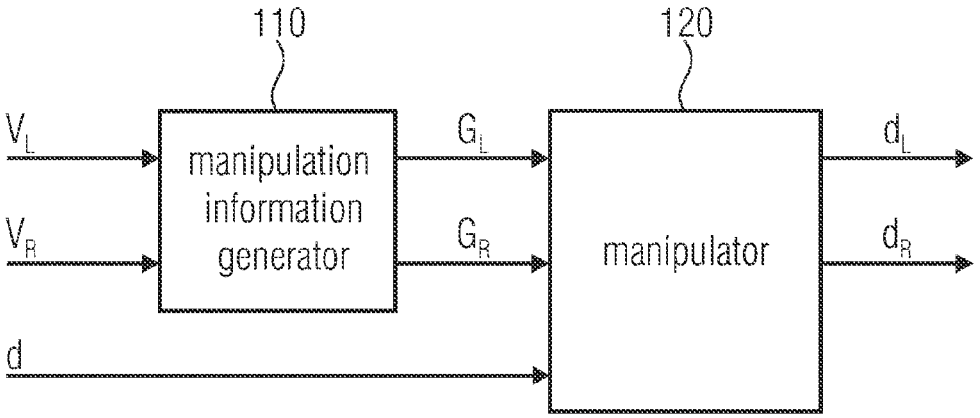
FIG. 1 illustrates an apparatus for generating a stereo output signal according to an embodiment.

FIG. 1 illustrates an apparatus for generating a stereo output signal according to an embodiment. The apparatus comprises a manipulation information generator 110 and a manipulator 120. The manipulation information generator 110 is adapted to generate a first manipulation information $G_L$ depending on a signal indication value $V_L$ of a first channel of a stereo input signal. Furthermore, the manipulation information generator 110 is adapted to generate a second manipulation information $G_R$ depending on a signal indication value $V_R$ of a second channel of the stereo input signal.

In an embodiment, the signal indication value $V_L$ of the first channel is an energy value of the first channel and the signal indication value $V_R$ of the second channel is an energy value of the second channel. In another embodiment, the signal indication value $V_L$ of the first channel is an amplitude value of the first channel and the signal indication value $V_R$ of the second channel is an amplitude value of the second channel.

The generated manipulation information $G_L$, $G_R$ is provided to a manipulator 120. Furthermore, a combination signal d is fed into the manipulator 120. The combination signal d is derived by the first and second input channel of the stereo input signal.

The manipulator 120 generates a first manipulated signal $d_L$ based on the first manipulation information $G_L$ and on the combination signal d. Furthermore, the manipulator 120 also generates a second manipulated signal $d_R$ based on the second manipulation information $G_R$ and on the combination signal d. The manipulator 120 is configured to manipulate the combination signal d in a first manner, when the first signal indication value $V_L$ is in a first relation to the second signal indication value $V_R$, or in a different second manner, when the first signal indication value $V_L$ is in a different second relation to the second signal indication value $V_R$.

In an embodiment, the combination signal d is a difference signal. For example, the second channel of the stereo input signal may have been subtracted from the first channel of the stereo input signal. Employing a difference signal as a combination signal is based on the finding that a difference signal is particularly suitable for being modified to generate a stereo output signal. This finding is based on the following:

A (mono) difference signal, also referred to as "S" (side) signal, is generated from a left and a right channel of a stereo input signal, e.g., in a time domain, by applying the formula:

$$S=x_L-x_R,$$

S: difference signal $x_L$: left input signal $x_R$: right input signal

Employing the above definitions of $x_L$ and $x_R$:

$$S = x_L - x_R = \left(\sum_k s_k + n_1\right) - \left(\sum_k a_k \cdot s_k + n_2\right)$$

By generating a difference signal according to the above formula, sound sources $s_k$ which are equally present in both input channels ($a_k$=1) are removed when generating the difference signal. (Sound sources which are equally present in both stereo input channels are assumed to originate from a location at a center position in front of the listener.) Furthermore, sound sources $s_k$ which are panned such that the sound source is almost equally present in both channels of the stereo input signal ($a_k \approx 1$) will be strongly attenuated in the difference signal.

However, sound sources which are panned such that they are only present (or mainly present) in the left channel of the stereo input signal ($a_k \rightarrow 0$), will not be attenuated at all (or will only be slightly attenuated). Moreover, sound sources which are panned such that they are only present (or mainly present) in the right channel ($a_k >> 1$), will also not be attenuated at all (or will only slightly be attenuated).

In general, ambient signal portions $n_1$ and $n_2$ of the left and right channel of a stereo input signal are only slightly correlated. They are therefore only slightly attenuated when forming the difference signal.

A difference signal may be employed in the process of generating a stereo output signal. If the S-signal is generated in a time domain, no artifacts are generated.

Figure 2:
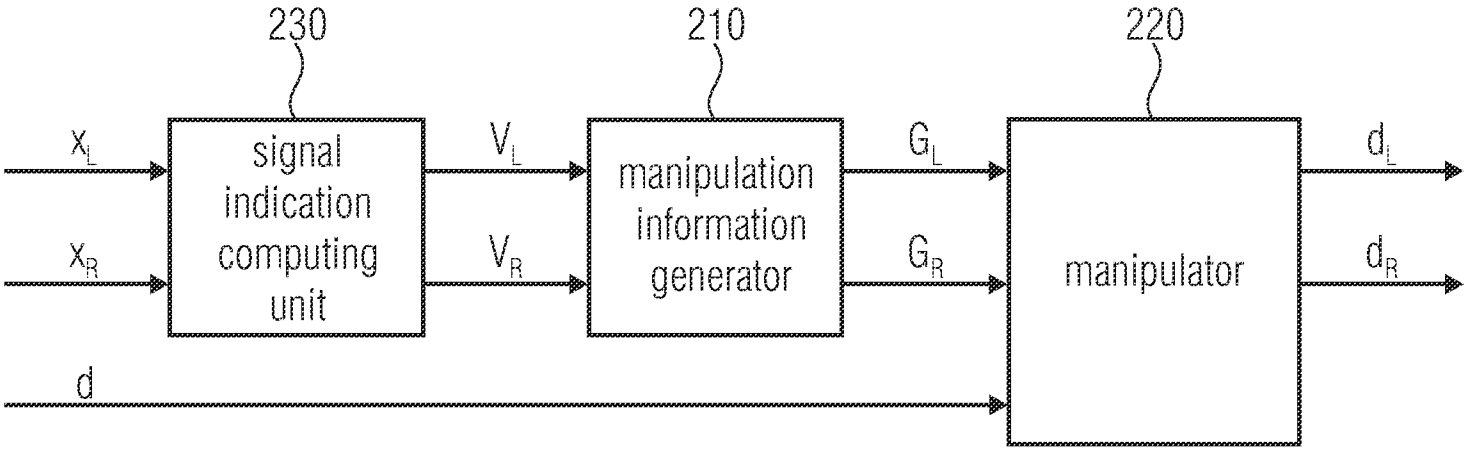
FIG. 2 depicts an apparatus for generating a stereo output signal according to another embodiment.

FIG. 2 illustrates an apparatus for generating a stereo output system according to another embodiment of the present invention. The apparatus comprises a manipulation information generator 210, a manipulator 220 and, moreover, an signal indication computing unit 230.

A first channel $x_L$ and a second channel $x_R$ of a stereo input signal are fed into a signal indication computing unit 230. The signal indication computing unit 230 computes a first signal indication value $V_L$ relating to the first input channel $x_L$ and a second signal indication value $V_R$ relating to the second input channel $x_L$. For example, a first energy value of the first input channel $x_L$ is computed as the first signal indication value $V_L$ and a second energy value of the second input channel $x_R$ is computed as the second signal indication value $V_R$. Alternatively, a first amplitude value of the first input channel $x_L$ is computed as the first signal indication value $V_L$ and a second amplitude value of the second input channel $x_R$ is computed as the second signal indication value $V_R$.

In other embodiments, more than two channels are fed into the signal indication computing unit 230 and more than two signal indication values are calculated, depending on the number of input channels which are fed into the signal indication computing unit 230.

The computed signal indication values $V_L$, $V_R$ are fed into the manipulation information generator 210.

The manipulation information generator 210 is adapted to generate manipulation information $G_L$ depending on the first signal indication value $V_L$ of the first channel $x_L$ of the stereo input signal and to generate manipulation information $G_R$ depending on the second signal indication value $V_R$ of the second channel $x_R$ of the stereo input signal. Based on the manipulation information $G_L$, $G_R$ generated by the manipulation information generator 210, the manipulator 220 generates a first and a second manipulated signal $d_L$, $d_R$ as a first and a second output channel of the stereo output signal, respectively. Furthermore, the manipulator 220 is configured for manipulating the combination signal d in a first manner when the first signal indication value $V_L$ is in a first relation to the second signal indication value $V_R$, or in a different second manner, when the first signal indication value $V_L$ is in a different second relation to the second signal indication value $V_R$.

Figure 3:
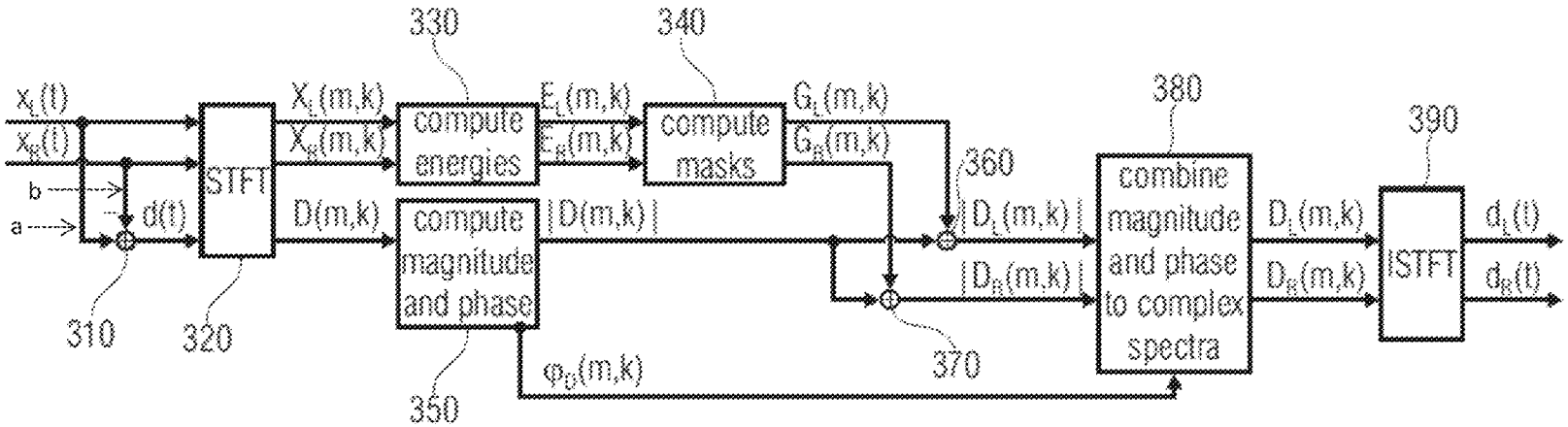
FIG. 3 shows an apparatus for generating a stereo output signal according to a further embodiment.

FIG. 3 illustrates an apparatus for generating a stereo output signal. A stereo input signal having two input channels $x_L(t)$, $x_R(t)$ which are represented in a time domain are fed into a transformer unit 320 and into a combination signal generator 310. The first $x_L(t)$ and the second $x_R(t)$ input channel may be the left $x_L(t)$ and the right $x_R(t)$ input channel of the stereo input signal, respectively. The input signals $x_L(t)$, $x_R(t)$ may be discrete-time signals.

The combination signal generator 310 generates a combination signal d(t) based on the first $x_L(t)$ and the second $x_R(t)$ input channel of a stereo input signal. The generated combination signal d(t) may be a discrete-time signal d(t). In an embodiment, the combination signal d(t) may be a difference signal and may, for example, be generated by subtracting the second (e.g., right) input channel $x_R(t)$ from the first (e.g., left) input channel $x_L(t)$ or vice versa, e.g., by applying the formula:

$$d(t)=x_L(t)-x_R(t).$$

In another embodiment, other kinds of combination signals are employed. For example, the combination signal generator 310 may generate a combination signal d(t) according to the formula:

$$d(t)=a\cdot x_L(t)-b\cdot x_R(t)$$

The parameters a and b are referred to as steering parameters. By selecting the steering parameters a and b, such that a is different from b, even a signal sound source which is not equally present in the channels $x_L(t)$, $x_R(t)$ of the stereo input signal can be removed when generating the combination signal d(t). Thus, by selecting a different from b, it is possible to remove sound sources which have been arranged, e.g. by employing amplitude panning, to a position left of the center or right of the center.

For example, consider the case where a sound source r(t) has been arranged such that it appears to originate from a position left of the center, e.g., by setting:

$$x_L(t)=2\cdot r(t)+f(t);\text{ and}$$

$$x_R(t)=0.5\cdot r(t)+g(t).$$

Then, setting the steering parameters a and b to a=0.5 and b=2, removes the signal source r(t) from the combination signal:

$$\begin{aligned} d(t) &= a\cdot x_L(t)-b\cdot x_R(t) \\ &= a\cdot(2\cdot r(t)+f(t))-b\cdot(0.5\cdot r(t)+g(t)) \\ &= 0.5\cdot(2\cdot r(t)+f(t))-2\cdot(0.5\cdot r(t)+g(t)) \\ &= 0.5\cdot f(t)-2\cdot g(t); \end{aligned}$$

In embodiments, the combination signal $d(t)=a\cdot x_L(t)-b\cdot x_R(t)$ is employed to remove a sound source originating from a certain position from the combination signal by setting the steering parameters a and b to appropriate values. The dominant sound source may, for example, be a dominant instrument in a music recording, e.g., an orchestra recording. The steering parameters a, b may be set to a value such that sounds originating from the position of the dominant sound source are removed when generating the combination signal.

In an embodiment, the steering parameters a and b can be dynamically adjusted depending on the input channels $x_L(t)$, $x_R(t)$ of the stereo input signal. For example, the combination signal generator 310 may be adjusted to dynamically adjust the steering parameters a and b such that a dominant sound source is removed from the combination signal. The position of the dominant sound source may vary. At one point in time, the dominant sound source is located at a first position, and at another point in time, the dominant sound source is located at a different second position, either, because the dominant sound source moves, or, because another sound source has become the dominant sound source in the recording. By dynamically adjusting the steering parameters a and b, the actual dominant sound source can be removed from the combination signal.

In a further embodiment, an energy relationship of the first and second input signal may be available in the combination signal generator 310. The energy relationship may, for example, indicate the relationship of an energy value of the first input channel $x_L(t)$ to an energy value of the second input channel $x_R(t)$. In such an embodiment, the values of the steering parameters a and b may be dynamically determined based on that energy relationship.

In an embodiment, the values of the steering parameters a and b may, for example, be chosen such that a=1; and $b=E(x_L(t))/E(x_R(t))$; (E(y)=energy value of y;). In other embodiments, other rules for determining the values of a and b may be employed.

Furthermore, in another embodiment, the combination signal generator may itself determine an energy relationship of the first and second input channel $x_L(t)$, $x_R(t)$, e.g., by analysing an energy relationship of the input channels in a time domain or a frequency domain.

In a further embodiment, an amplitude relationship of the first and second input channel $x_L(t)$, $x_R(t)$ is available in the combination signal generator 310. The amplitude relationship may, for example, indicate the relationship of an amplitude value of the first input channel $x_L(t)$ to an amplitude value of the second input channel $x_R(t)$. In such an embodiment, the values of the steering parameters a, b may be dynamically determined based on the amplitude relationship. The determination of the steering parameters a and b may be conducted similar as in the embodiments, wherein a and b are determined based on an energy relationship. In a further embodiment, the combination signal generator may itself determine an amplitude relationship of the first and second input channel $x_L(t)$, $x_R(t)$, for example, by transforming the input channels $x_L(t)$, $x_R(t)$ from a time domain into a frequency domain, e.g., by applying Short-Time Fourier Transformation, by determining the amplitude values of the frequency domain representations of both channels $x_L(t)$, $x_R(t)$ and by setting one or a plurality of amplitude values of the first input channel $x_L(t)$ into a relationship to one or a plurality of amplitude values of the second input channel $x_R(t)$. When a plurality of amplitude values of the first input channel $x_L(t)$ is set into a relationship to a plurality of amplitude values of the second input channel $x_R(t)$, a mean value for the first and a mean value for the second plurality of amplitude values may be calculated.

The apparatus in the embodiment of FIG. 3 furthermore comprises a first transformer unit 320. The combination signal generator 310 feeds the combination signal d(t) into the first transformer unit 320. Moreover, the first $x_L(t)$ and second $x_R(t)$ input channel of the stereo input signal are also fed into the first transformer unit 320. The first transformer unit 320 transforms the first input channel $x_L(t)$, the second input channel $x_R(t)$ and the difference signal d(t) into a frequency domain by employing a suitable transformation method.

In the embodiment of FIG. 3, the first transformer unit 320 employs a filter bank to transform the discrete-time input channels $x_L(t)$, $x_R(t)$ and the discrete-time difference signal d(t) into a frequency domain, e.g., by employing Short-Time Fourier Transform (STFT). In other embodiments, the first transformer unit 320 may be adapted to employ other kinds of transformation methods, e.g., a QMF (Quadrature Mirror Filter) filter bank, to transform the signals from a time domain into a frequency domain.

After transforming the input channels $x_L(t)$, $x_R(t)$ and the difference signal d(t) by employing Short-Time Fourier Transform, the frequency domain difference signal D(m,k) and the frequency domain first $X_L(m,k)$ and second $X_R(m,k)$ input channel represent complex spectra. m is the STFT time index, k is the frequency index.

The first transformer unit 320 feeds the complex frequency domain signal D(m,k) of the difference signal into an amplitude-phase computing unit 350. The amplitude-phase computing unit computes the amplitude spectra |D(m,k)| and the phase spectra $\phi_D$(m,k) from the complex spectra of the frequency domain difference signal D(m,k).

Furthermore, the first transformer unit 320 feeds the complex frequency domain first $X_L$(m,k) and second $X_R$(m, k) input channel into an signal indication computing unit 330. The signal indication computing unit 330 computes first signal indication values from the first frequency domain input channel $X_L$(m,k) and second signal indication values from the second frequency domain input channel $X_R$(m,k). More specifically, in the embodiment of FIG. 3, the signal indication computing unit 330 computes first energy values $E_L$(m,k) as first signal indication values from the first frequency domain input channel $X_L$(m,k) and second energy values $E_R$(m,k) as second signal indication values from the second frequency domain input channel $X_R$(m,k).

The signal indication computing unit 330 considers each signal portion, e.g., each time-frequency bin (m,k), of the first $X_L$(m,k) and second $X_R$(m,k) frequency domain input channel. With respect to each time-frequency bin, the signal indication computing unit 330 in the embodiment of FIG. 3 computes a first energy $E_L$(m,k) relating to the first frequency domain input channel $X_L$(m,k) and a second energy $E_R$(m,k) relating to the second frequency domain input channel $X_R$(m,k). For example, the first and second energies $E_L$(m,k) and $E_R$(m,k) may be computed according to the following formulae:

$$E_L(m,k)=(Re\{X_L(m,k)\})^2+(Im\{X_L(m,k)\})^2$$

$$E_R(m,k)=(Re\{X_R(m,k)\})^2+(Im\{X_R(m,k)\})^2.$$

In another embodiment, the signal indication computing unit 330 computes amplitude values of the first $X_L$(m,k) frequency domain input channel as first signal indication values and amplitude values of the second $X_R$(m,k) frequency domain input channel as second signal indication values. In such an embodiment, the signal indication computing unit 330 may determine an amplitude value for each time-frequency bin of the first frequency domain input signal $X_L$(m,k) to derive the first signal indication values. Furthermore, the signal value computing unit 330 may determine an amplitude value for each time-frequency bin of the second frequency domain input signal $X_R$(m,k) to derive the second signal indication values.

The signal indication computing unit 330 of FIG. 3 passes the signal indication values, e.g., the energy values $E_L$(m,k), $E_R$(m,k), of the first and second input channel $X_L$(m,k), $X_R$(m,k) to a manipulation information generator 340.

In the embodiment of FIG. 3, the manipulation information generator 340 generates a weighting mask, e.g., a weighting factor, for each time-frequency bin of each input signal $X_L$(m,k), $X_R$(m,k). Depending on the relationship of the first and second signal indication values, e.g., depending on the energy relations of the left and the right frequency-domain signal, the weighting mask $G_L$(m,k) relating to the first input signal $X_L$(m,k), and the weighting mask $G_R$(m,k) relating to the second input signal $X_R$(m,k) are generated. Regarding a particular time-frequency bin, $G_L$(m, k) has a value close to 1, if $E_L$(m, k)>>$E_R$(m, k). On the other hand, $G_L$(m, k) has a value close to 0, if $E_R$(m, k)>>$E_L$(m, k). For the right weighting mask the opposite applies. In embodiments where the manipulation information generator receives amplitude values as first and second signal indication values, the same applies likewise.

The weighting masks may, for example, be calculated according to the formulae:

$$G_L(m,k)=\frac{E_L(m,k)}{E_L(m,k)+E_R(m,k)};\text{ and}$$

$$G_R(m,k)=\frac{E_R(m,k)}{E_L(m,k)+E_R(m,k)}.$$

An adjustable parameter may be employed to calculate the weighting masks, which becomes relevant, if a sound source is not located at the far left or at the far right, but in between these values. Other examples on how to compute the weighting masks $G_L$(m,k), $G_R$(m,k) will be described later on with reference to FIG. 5.

The signal value computing unit 330 feeds the generated first weighting mask $G_L$(m,k) into a first manipulator 360. Moreover, the amplitude-phase computing unit 350 feeds the amplitude values |D(m,k)| of the difference signal D(m, k) into the first manipulator 360. The first weighting mask $G_L$(m,k) is then applied to an amplitude value of the difference signal to obtain a first modified amplitude value $|D_L(m,k)|$ of the difference signal D(m,k). The first weighting mask $G_L$(m,k) may be applied to the amplitude value |D(m,k)| of the difference signal D(m,k), e.g., by multiplying the amplitude value |D(m,k)| by $G_L$(m,k), wherein |D(m,k)| and $G_L$(m,k) relate to the same time-frequency bin (m, k). The first manipulator 360 generates modified amplitude values $|D_L(m,k)|$ for all time-frequency bins for which it receives a weighting mask value $G_L$(m,k) and a difference signal amplitude value |D(m,k)|.

Furthermore, the signal value computing unit 330 feeds the generated second weighting mask $G_R$(m,k) into a second manipulator 370. Moreover, the amplitude-phase computing unit 350 feeds the amplitude spectra |D(m,k)| of the difference signal D(m,k) into the second manipulator 370. The second weighting mask $G_R$(m,k) is then applied to an amplitude value of the difference signal to obtain a second modified amplitude value $|D_L(m,k)|$ of the difference signal D(m,k). Again, the second weighting mask $G_R$(m,k) may be applied to the amplitude value |D(m,k)| of the difference signal D(m,k), e.g., by multiplying the amplitude value |D(m,k)| by $G_R$(m,k), wherein |D(m,k)| and $G_R$(m,k) relate to the same time-frequency bin (m,k). The second manipulator 370 generates modified amplitude values $|D_R(m,k)|$ for all time-frequency bins for which it receives a weighting mask value $G_R$(m,k) and a difference signal amplitude value |D(m,k)|.

The first modified amplitude values $|D_L(m,k)|$ as well as the second modified amplitude values $|D_R(m,k)|$ are fed into a combiner 380. The combiner 380 combines each one of the first modified amplitude values $|D_L(m,k)|$ with the corresponding phase value (the phase value which relates to the same time-frequency bin) of the difference signal $\phi_D$(m,k) to obtain a complex first frequency domain output channel $D_L$(m,k). Moreover, the combiner 380 combines each one of the second modified amplitude values $|D_R(m,k)|$ with the corresponding phase value (which relates to the same time-frequency bin) of the difference signal $\phi_D$(m,k) to obtain a complex second frequency domain output channel $D_R$(m,k).

According to another embodiment, the combiner 380 combines each one of the first amplitude values $|D_L(m,k)|$ with the corresponding phase value (the phase value which relates to the same time-frequency bin) of the first, e.g., left, input channel $X_L$(m,k), and furthermore combines each one of the second amplitude values $|D_R(m,k)|$ with the corresponding phase value (the phase value which relates to the same time-frequency bin) of the second, e.g., right, input channel $X_R(m,k)$.

In other embodiments, the first $|D_L(m,k)|$ and the second $|D_R(m,k)|$ amplitude values may be combined with a combined phase value. Such a combined phase value $\phi_{comb}(m,k)$ may, for example, be obtained, by combining a phase value of the first input signal $\phi_{x1}(m,k)$ and a phase value of the second input signal $\phi_{x2}(m,k)$, e.g., by applying the formula:

$$\phi_{comb}(m,k)=(\phi_{x1}(m,k)+\phi_{x2}(m,k))/2.$$

In other embodiments a first combination of the first and second amplitude values is applied to the phase values of the first input signal and a second combination of the first and second amplitude values is applied to the phase values of the second input signal.

The combiner 380 of FIG. 3 feeds the generated first and second complex frequency domain output signals $D_L(m,k)$, $D_R(m,k)$ into a second transformer unit 390. The second transformer unit 390 transforms the first and second complex frequency domain output signals $D_L(m,k)$, $D_R(m,k)$ into a time domain, e.g., by conducting Inverse Short-Time Fourier Transform (ISTFT), to obtain a first time domain output signal $d_L(t)$ from the first frequency domain output signal $D_L(m,k)$ and to obtain a second time domain output signal $d_R(t)$ from the second frequency domain output signal $D_R(m,k)$, respectively.

Figure 4:
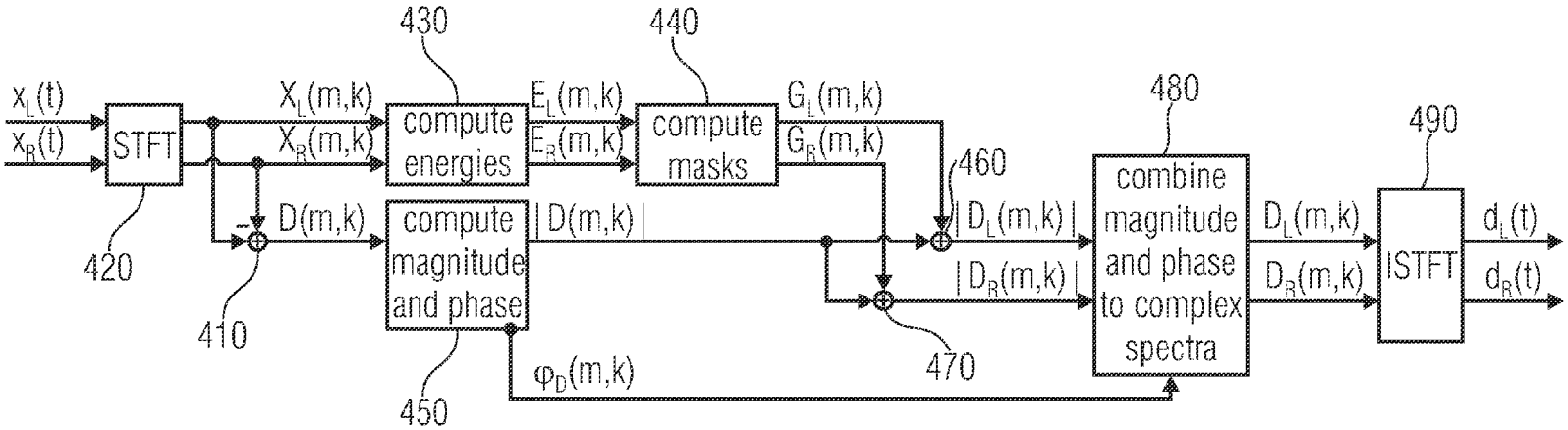
FIG. 4 illustrates another embodiment of an apparatus for generating a stereo output signal.

FIG. 4 illustrates a further embodiment. The embodiment of FIG. 4 differs from the embodiment depicted in FIG. 3 insofar, as transformer unit 420 is only transforming a first and second input channel $x_L(t)$, $x_R(t)$ from a time domain into a spectral domain. However, transformer unit does not transform a combination signal. Instead, a combination signal generator 410 is provided which generates a frequency domain combination signal from the first and second frequency domain input channel $X_L(m,k)$ and $X_R(m,k)$. As the combination signal is generated in a frequency domain, a transformation step has been saved, as transforming the combination signal into a frequency domain is avoided. The combination signal generator 410 may, for example, generate a frequency domain difference signal, e.g., by applying the following formula for each time-frequency bin:

$$D(m,k)=X_L(m,k)-X_R(m,k).$$

In another embodiment, the combination signal generator may employ any other kind of combination signal, for example:

$$D(m,k)=a\cdot X_L(m,k)-b\cdot X_R(m,k).$$

Figure 5:
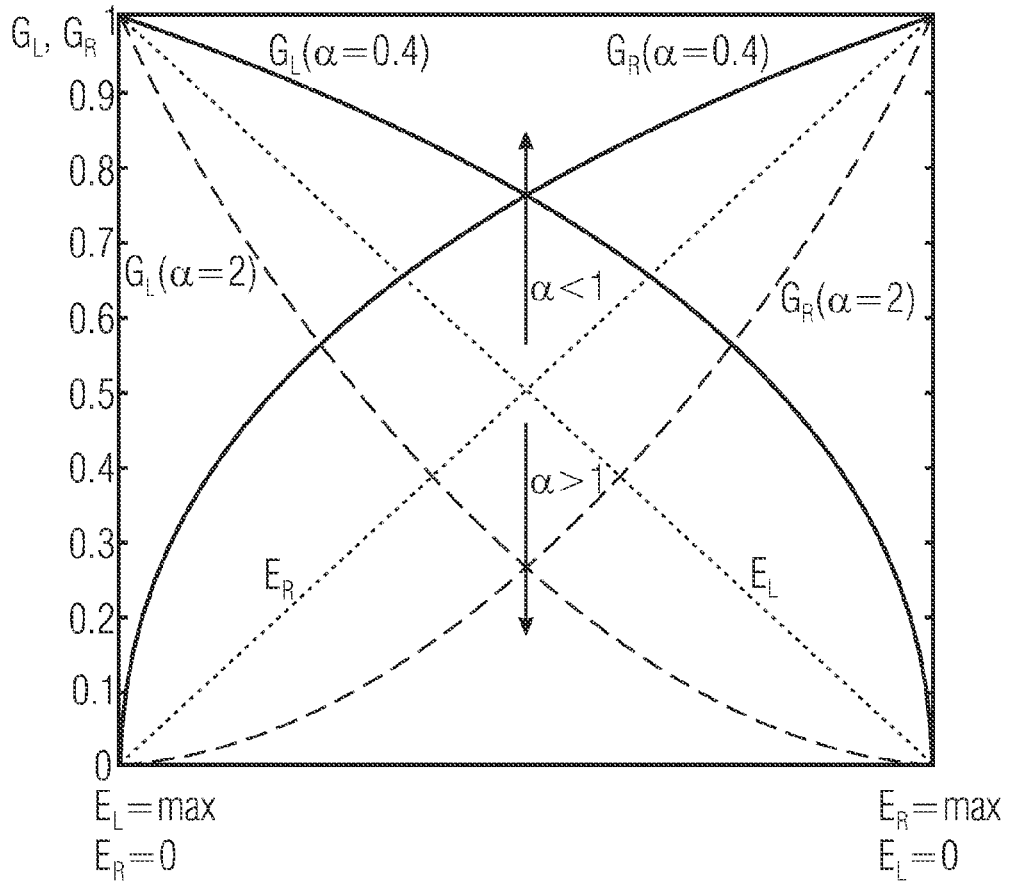
FIG. 5 illustrates a diagram displaying different weighting masks in relation to energy values according to an embodiment of the present invention.

FIG. 5 illustrates the relationship between weighting masks $G_L$, $G_R$ and energy values $E_L$, $E_R$, taking a tuning parameter $\alpha$ into account. While the following explanations primarily relate to the relationship of weighting masks and energy values, they are equally applicable to the relationship of weighting masks and amplitude values, for example, in the case when a manipulation information generator generates weighting masks based on amplitude values of the first and second input channel. Therefore, the explanations and formulae are equally applicable for amplitude values.

Conceptually, weighting masks are generated based on the rules for calculating the center of gravity between two points:

$$x_c = \frac{m_1 \cdot x_1 + m_2 \cdot x_2}{m_1 + m_2}$$

$x_c$: center of gravity
$x_1$: point 1
$x_2$: point 2
$m_1$: mass at point 1
$m_2$: mass at point 2

If this formula is used for calculating the "center of gravity" of the energy values $E_L(m,k)$ and $E_R(m, k)$, this results in:

$$C(m, k) = \frac{E_L(m, k)\cdot x_1 + E_R(m, k)\cdot x_2}{E_L(m, k) + E_R(m, k)}$$

$C(m,k)$: center of gravities of the energy values $E_L(m, k)$ and $E_R(m, k)$.

To obtain a weighting mask for the left channel, $x_1$ is set to $x_1=1$ and $x_2$ is set to $x_2=0$:

$$G_L(m, k) = \frac{E_L(m, k)}{E_L(m, k) + E_R(m, k)},$$

Such a weighting mask $G_L(m,k)$ has the desired result that $G_L(m,k)\rightarrow>1$ in case of left-panned signals ($E_L(m, k)>>E_R(m, k)$) and the desired result that $G_L(m,k)\rightarrow 0$ in case of right-panned signals ($E_R(m, k)>>E_L(m, k)$).

Similarly, a weighting mask for the right channel is obtained by setting $x_1=0$ and $x_2=1$:

$$G_R(m, k) = \frac{E_R(m, k)}{E_L(m, k) + E_R(m, k)},$$

This weighting mask $G_R(m,k)$ has the desired result that $G_R(m,k)\rightarrow 1$ in case of right-panned signals ($E_R(m, k)>>E_L(m, k)$) and the desired result that $G_R(m,k)\rightarrow 0$ in case of left-panned signals ($E_L(m, k)>>E_R(m, k)$).

Regarding center-panned input signals ($E_L(m,k)=E_R(m, k)$), the weighting masks $G_L(m,k)$ and $G_R(m,k)$ are equal to 0.5. A parameter $\alpha$ is used to steer the behavior of the weighting masks regarding center-panned signals and signals which are panned close to center, wherein $\alpha$ is an exponent applied on the weighting masks according to:

$$G_L(m, k) = \left(\frac{E_L(m, k)}{E_L(m, k) + E_R(m, k)}\right)^{\alpha}$$

$$G_R(m, k) = \left(\frac{E_R(m, k)}{E_L(m, k) + E_R(m, k)}\right)^{\alpha}$$

The weighting masks $G_L(m, k)$ and $G_R(m, k)$ are calculated based on the energies by means of these formulas.

As stated above, these formulas are equally applicable for amplitude values $|X_L(m,k)|$, $|X_R(m,k)|$ of a first and a second input channel. In that case, $E_L(m,k)$ has the value of $|X_L(m, k)|$ and $E_R(m,k)$ has the value of $|X_R(m,k)|$, e.g., in embodiments, where a manipulation information generator generates weighting masks based on amplitude values instead of energy values.

FIG. 5 illustrates the effects of applying tuning parameter $\alpha$ by illustrating curves relating to different values of the tuning parameter. If $\alpha$ is set to $\alpha=0.4$, bins, which comprise equal or similar energies in the left and right input channel are slightly attenuated. Only bins, which have a significantly higher energy in the right channel are strongly attenuated by the left weighting mask $G_L(m, k)$. Analogously, bins, which have a significantly higher energy in the left channel are strongly attenuated by the right weighting mask $G_R(m, k)$. As only few signal portions are strongly attenuated by such a filter, such a setting of the tuning parameter may be referred to as "low selectivity".

A higher parameter value, for example, $\alpha=2$ results in considerably "higher selectivity". As can be seen in FIG. 5, bins having equal or similar energy in the left and the right channel are heavily attenuated. Depending on the application, the desired selectivity may be steered by the tuning parameter $\alpha$.

Figure 6:
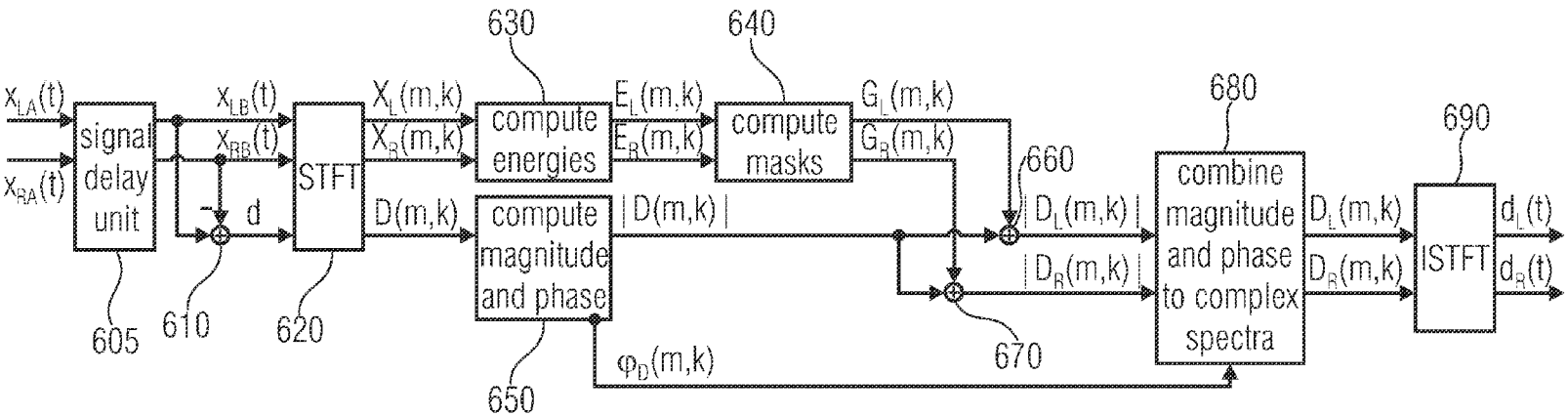
FIG. 6 depicts an apparatus for generating a stereo output signal according to a further embodiment.

FIG. 6 illustrates an apparatus for generating a stereo output signal according to a further embodiment. The apparatus of FIG. 6 differs from the embodiment of FIG. 3 inter alia, as it further comprises a signal delay unit 605. A first $x_{LA}(t)$ and a second $x_{RA}(t)$ input channel of a stereo input signal are fed into the signal delay unit 605. The first and the second input channel $x_{LA}(t)$, $x_{RA}(t)$ are also fed into a first transformer unit 620.

The signal delay unit 605 is adapted to delay the first input channel $x_{LA}(t)$ and/or the second input channel $x_{RA}(t)$. In an embodiment, the signal delay unit determines a delay time, by employing a correlation analysis of the first and second input channel $x_{LA}(t)$, $x_{RA}(t)$. For example, $x_{LA}(t)$ and $x_{RA}(t)$ are time-shifted on a step-by-step basis. For each step, a correlation analysis is conducted. Then, the time-shift with the maximum correlation is determined. Assuming that delay panning has been employed to arrange a signal source in the stereo input signal, such that it appears to originate from a particular position, the time-shift with the maximum correlation is assumed to correspond to the delay originating from the delay panning. In an embodiment, the signal delay unit may rearrange the delay-panned signal source such that it is rearranged to a center position. For example, if the correlation analysis indicates that input channel $x_{LA}(t)$ has been delayed by $\Delta t$, then signal delay unit 605 delays input channel $x_{RA}(t)$ by $\Delta t$.

The eventually modified first $x_{LB}(t)$ and second $x_{RB}(t)$ channel are subsequently fed into the combination signal generator 620 which generates a combination signal. In an embodiment, the combination signal generator generates a difference signal as a combination signal by applying the formula:

$$d(t)=x_{LB}(t)-x_{RB}(t).$$

As the delay-panned signal source has been rearranged to a center position, the signal source is then equally present in the eventually modified first and second channels $x_{LB}(t)$, $x_{RB}(t)$, and will therefore be removed from the difference signal d(t). By employing an apparatus according to the embodiment of FIG. 6, it is therefore possible to generate a combination signal without corresponding delay-panned signal sources.

Figure 7:
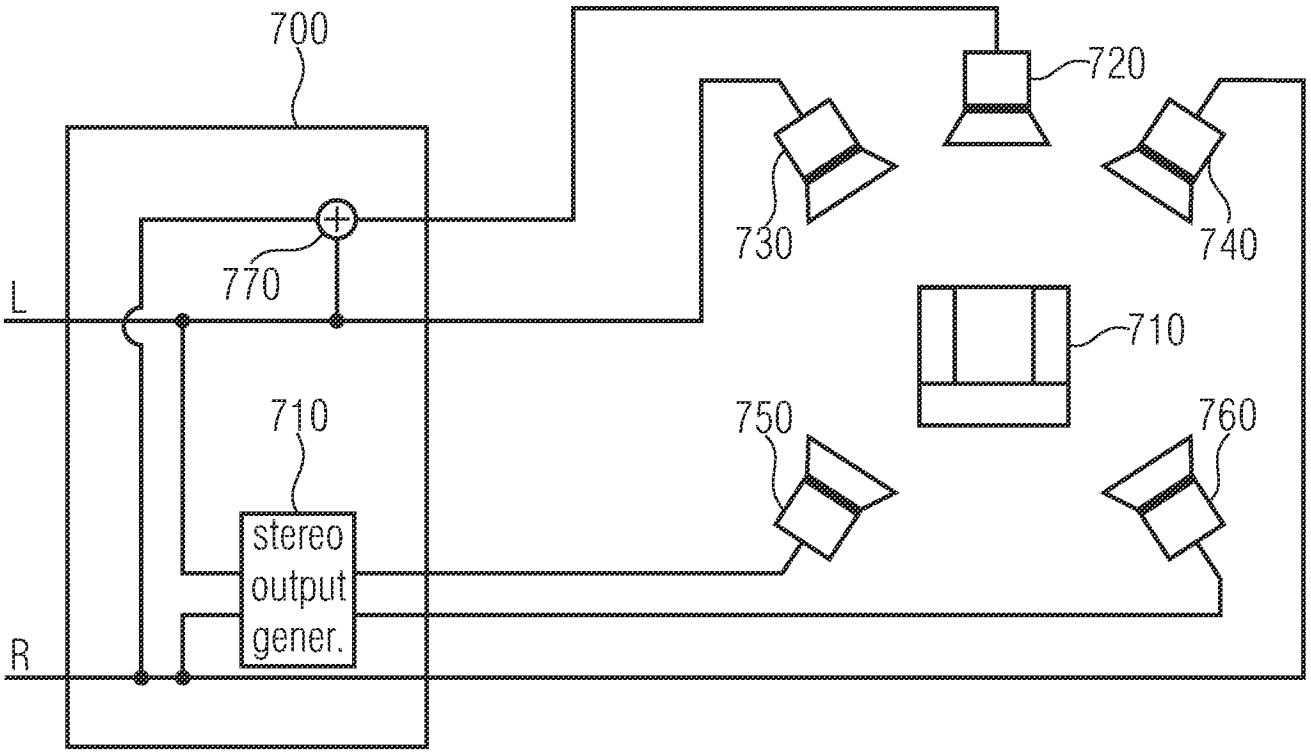
FIG. 7 illustrates an upmixer according to an embodiment.

FIG. 7 illustrates an upmixer 700 for upmixing a stereo input signal to five output channels, e.g. five channels of a surround system. The stereo input signal has a first input channel L and a second input channel R which are fed into the upmixer 700. The five output channels may be a center channel, a left front channel, a right front channel, a left surround channel and a right surround channel. The center channel, the left front channel, the right front channel, the left surround channel and the right surround channel are provided to a center loudspeaker 720, a left front loudspeaker 730, a right front loudspeaker 740, a left surround loudspeaker 750 and a right surround loudspeaker 760, respectively. The loudspeakers may be positioned around a listener's seat 710.

The upmixer 700 generates the center channel for the center loudspeaker 720 by adding the left input channel L and the right input channel R of the stereo input signal. The upmixer 700 may provide the left input channel L unmodified to the left front loudspeaker 730 and may further provide the right input channel R unmodified to the right front loudspeaker 740. Furthermore, the upmixer comprises an apparatus 770 for generating a stereo output signal according to one of the above-described embodiments. The left input channel L and the right input channel R are fed into the apparatus 770, as a first and second input channel of the apparatus for generating a stereo output signal 770, respectively. The first output channel of the apparatus 770 is provided to the left surround speaker 750 as the left surround channel, while the second output channel of the apparatus 770 is provided to the right surround speaker 760 as the right surround channel.

Figure 8:
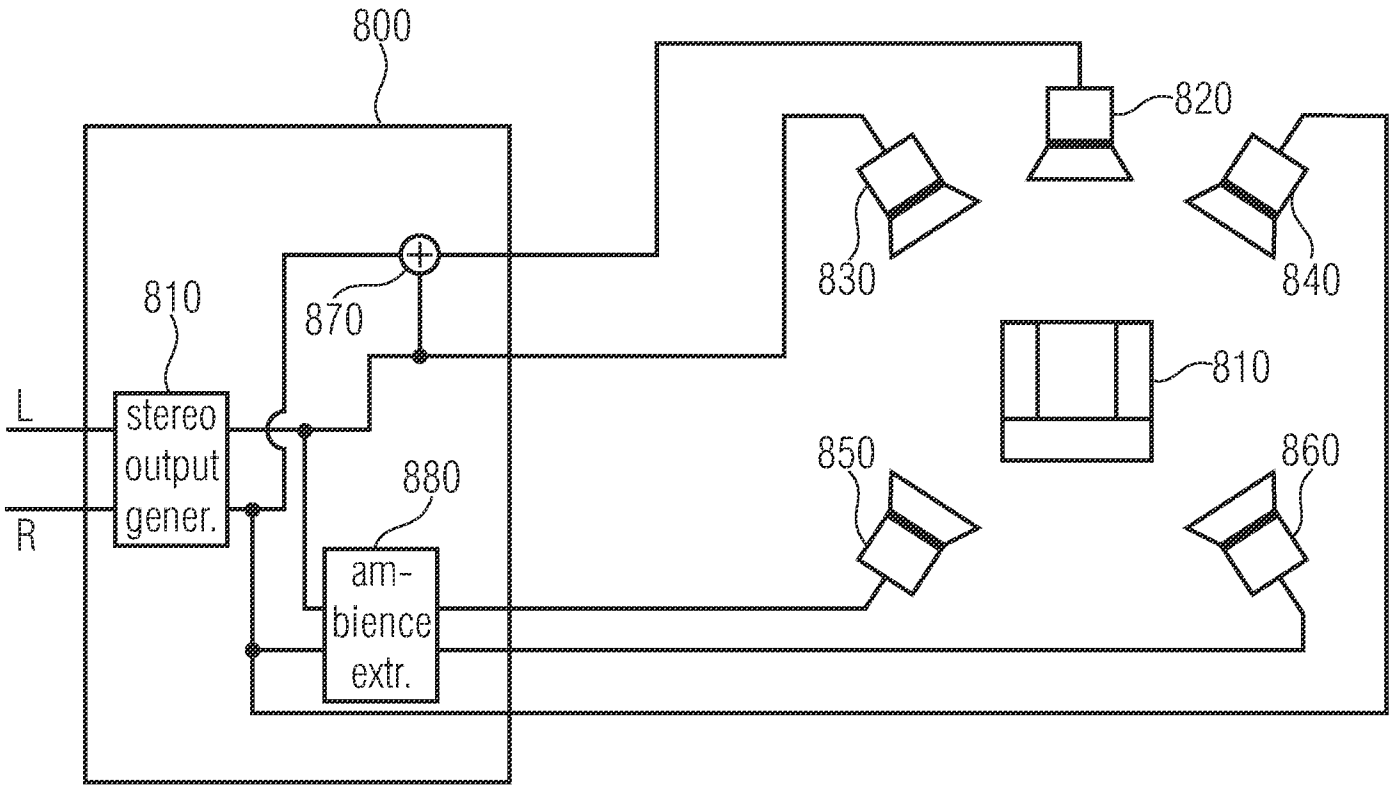
FIG. 8 depicts an upmixer according to a further embodiment.

FIG. 8 illustrates a further embodiment of an upmixer 800 having five output channels, e.g. five channels of a surround system. The stereo input signal has a first input channel L and a second input channel R which are fed into the upmixer 800. As in the embodiment illustrated in FIG. 7, the five output channels may be a center channel, a left front channel, a right front channel, a left surround channel and a right surround channel. The center channel, the left front channel, the right front channel, the left surround channel and the right surround channel are provided to a center loudspeaker 820, a left front speaker 830, a right front speaker 840, a left surround speaker 850 and a right surround speaker 860, respectively. Again, the loudspeakers may be positioned around a listener's seat 810.

The center channel provided to the center loudspeaker 820 is generated by adding the left L and the right R input channel Furthermore, the upmixer comprises an apparatus 870 for generating a stereo output signal according to one of the above-described embodiments. The left input channel L and the right input channel R are fed into the apparatus 870. The apparatus 870 generates a first and second output channel of a stereo output signal. The first output channel is provided to the left front loudspeaker 830; the second output channel is provided to the right front loudspeaker 840. Furthermore, the first and the second output channel generated by the apparatus 870 are provided to an ambience extractor 880. The ambience extractor 880 extracts a first ambience signal component from the first output channel generated by the apparatus 870 and provides the first ambience signal component to the left surround loudspeaker 850 as the left surround channel. Furthermore, the ambience extractor 880 extracts a second ambience signal component from the second output channel generated by the apparatus 870 and provides the second ambience signal component to right surround loudspeaker 860 as the right surround channel.

Figure 9:
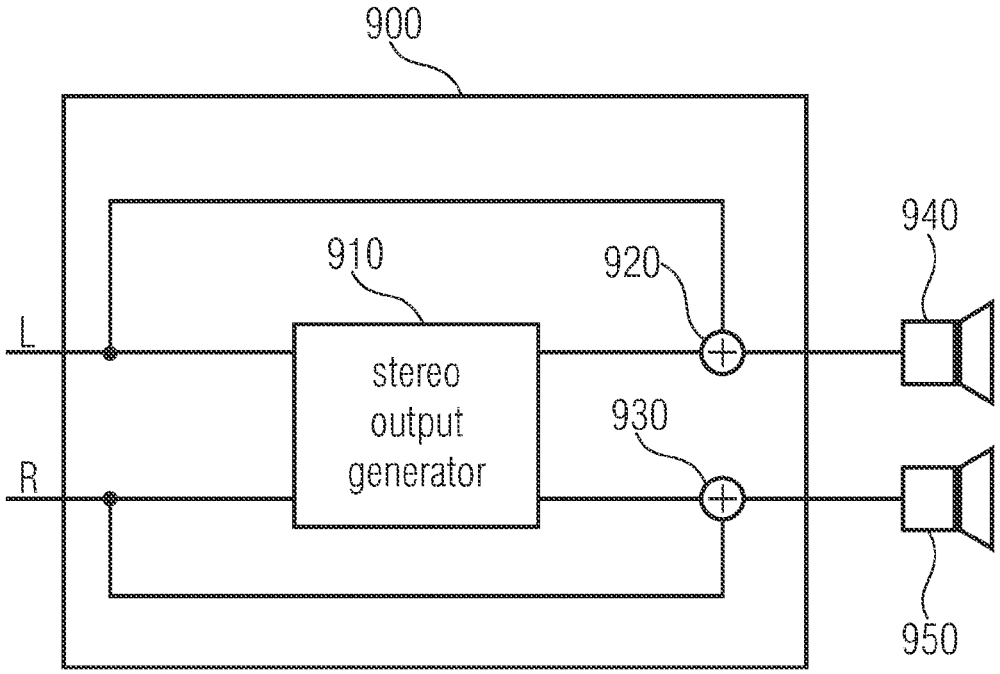
FIG. 9 shows an apparatus for stereo-base widening according to an embodiment.

FIG. 9 illustrates an apparatus for stereo-base widening 900 according to an embodiment. In FIG. 9, a first input channel L and a second input channel R of a stereo input signal are fed into the apparatus 900. The apparatus for stereo-base widening 900 comprises an apparatus 910 for generating a stereo output signal according to one of the above-described embodiments. The first and the second input channel L, R of the apparatus for stereo-base widening 900 are fed into the apparatus 910 for generating a stereo output signal.

The first output channel of the apparatus for generating a stereo output signal 910 is fed into a first combiner 920 which combines the first input channel L and the first output channel of the apparatus for generating a stereo output signal 910 to generate a first output channel of the apparatus for stereo-base widening 900.

Correspondingly, the second output channel of the apparatus for generating a stereo output signal 910 is fed into a second combiner 930 which combines the second input channel R and the second output channel of the apparatus for generating a stereo output signal 910 to generate a second output channel of the apparatus for stereo-base widening 900.

By this, a widened stereo output signal is generated. The combiners may combine both received channels, e.g., by adding both channels, by employing a linear combination of both channel, or by another method of combining two channels.

Figure 10:
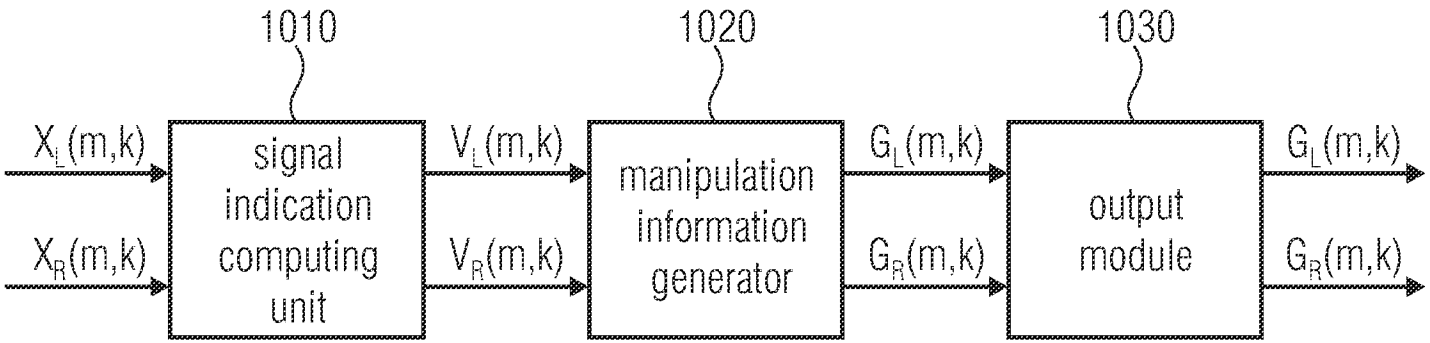
FIG. 10 depicts an encoder according to an embodiment.

FIG. 10 illustrates an encoder according to an embodiment. A first $X_L(m,k)$ and second $X_R(m,k)$ channel of a stereo signal are fed into the encoder. The stereo signal may be represented in a frequency domain.

The encoder comprises an signal indication computing unit 1010 for determining a first signal indication value $V_L$ and a second signal indication value $V_R$ of the first and second channel $X_L(m,k)$, $X_R(m,k)$ of a stereo signal, e.g., a first and second energy value $E_L(m,k)$, $E_R(m,k)$ of the first and second channel $X_L(m,k)$, $X_R(m,k)$. The encoder may be adapted to determine the energy values $E_L(m,k)$, $E_R(m,k)$ in a similar way as the apparatus for generating a stereo output signal in the above-described embodiments. For example, the encoder may determine the energy values by employing the formulae:

$$E_L(m,k)=(Re\{X_L(m,k)\})^2+(Im\{X_L(m,k)\})^2$$

$$E_R(m,k)=(Re\{X_R(m,k)\})^2+(Im\{X_R(m,k)\})^2.$$

In another embodiment, the signal indication computing unit 1010 may determine amplitude values of the first and second channel $X_L(m,k)$, $X_R(m,k)$. In such an embodiment, the signal indication computing unit 1010 may determine the amplitude values of the first and second channel $X_L(m,k)$, $X_R(m,k)$ in a similar way as the apparatus for generating a stereo output signal in the above-described embodiments.

The signal value computing unit 1010 feeds the determined energy values $E_L(m,k)$, $E_R(m,k)$ and/or the determined amplitude values into a manipulation information generator 1020. The manipulation information generator 1020 then generates manipulation information, e.g., a first $G_L(m,k)$ and a second $G_R(m,k)$ weighting mask based on the received energy values $E_L(m,k)$, $E_R(m,k)$ and/or amplitude values, by applying similar concepts as the apparatus for generating a stereo output signal in the above-described embodiments, particularly as explained with respect to FIG. 5.

In an embodiment, the manipulation information generator 1020 may determine the manipulation information based on the amplitude values of the first and second channel $X_L(m,k)$, $X_R(m,k)$. In such an embodiment, the manipulation information generator 1020 may apply similar concepts as the apparatus for generating a stereo output signal in the above-described embodiments.

The manipulation information generator 1020 then passes the weighting masks $G_L(m,k)$ and $G_R(m,k)$, to an output module 1030.

The output module 1030 outputs the manipulation information, e.g., the weighting masks $G_L(m,k)$ and $G_R(m,k)$, in a suitable data format, e.g., in a bit stream or as values of a signal.

The outputted manipulation information may be transmitted to a decoder which generates a stereo output signal by applying the transmitted manipulation information, e.g., by combining the transmitted weighting masks with a difference signal or with a stereo input signal as described with respect to the above-described embodiments of the apparatus for generating a stereo output signal.

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus.

Depending on certain implementation requirements, embodiments of the invention can be implemented in hardware or in software. The implementation can be performed using a digital storage medium, for example a floppy disk, a DVD, a CD, a ROM, a PROM, an EPROM, an EEPROM or a FLASH memory, having electronically readable control signals stored thereon, which cooperate (or are capable of cooperating) with a programmable computer system such that the respective method is performed.

Some embodiments according to the invention comprise a data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may for example be stored on a machine readable carrier.

Other embodiments comprise the computer program for performing one of the methods described herein, stored on a machine readable carrier or a non-transitory storage medium.

In other words, an embodiment of the inventive method is, therefore, a computer program having a program code for performing one of the methods described herein, when the computer program runs on a computer.

A further embodiment of the inventive methods is, therefore, a data carrier (or a digital storage medium, or a computer-readable medium) comprising, recorded thereon, the computer program for performing one of the methods described herein.

A further embodiment of the inventive method is, therefore, a data stream or a sequence of signals representing the computer program for performing one of the methods described herein. The data stream or the sequence of signals may for example be configured to be transferred via a data communication connection, for example via the Internet.

A further embodiment comprises a processing means, for example a computer, or a programmable logic device, configured to or adapted to perform one of the methods described herein.

A further embodiment comprises a computer having installed thereon the computer program for performing one of the methods described herein.

In some embodiments, a programmable logic device (for example a field programmable gate array) may be used to perform some or all of the functionalities of the methods described herein. In some embodiments, a field programmable gate array may cooperate with a microprocessor in order to perform one of the methods described herein. Generally, the methods are advantageously performed by any hardware apparatus.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations and equivalents as fall within the true spirit and scope of the present invention.

The invention claimed is:

1. An apparatus for generating a stereo output signal comprising a first output channel and a second output channel from a stereo input signal comprising a first input channel and a second input channel comprising:

a manipulation information generator being adapted to generate manipulation information depending on a first signal indication value of the first input channel and on a second signal indication value of the second input channel; wherein the manipulation information generator is configured to determine the manipulation information using the first signal indication value and using the second signal indication value for computing a first weighting mask; and wherein the manipulation information generator is configured to determine the manipulation information using the first signal indication value and using the second signal indication value for computing a second weighting mask, being different from the first weighting mask; and a manipulator for generating the first output channel by applying the first weighting mask on a combination signal, wherein the combination signal is a signal derived by combining the first input channel and the second input channel; and wherein the manipulator is configured to generate the second output channel by applying the second weighting mask on the combination signal, said combination signal being the combination signal on which the first weighting mask is applied to generate the first output channel.

2. The apparatus according to claim 1, wherein the manipulation information generator is adapted to generate the manipulation information depending on a first energy value as the first signal indication value of the first input channel and on a second energy value as the second signal indication value of the second input channel; and wherein the manipulator is configured for manipulating the combination signal in a first manner when the first energy value is in a first relation to the second energy value, or in a different second manner, when the first energy value is in a different second relation to the second energy value.

3. The apparatus according to claim 1, wherein the manipulation information generator is adapted to generate the manipulation information depending on the first signal indication value of the first input channel and on the second signal indication value of the second input channel, wherein the first signal indication value of the first input channel depends on an amplitude value of the first input channel;

wherein the second signal indication value of the second input channel depends on an amplitude value of the second input channel; and wherein the manipulator is configured for manipulating the combination signal in a first manner when the first signal indication value is in a first relation to the second signal indication value, or in a different second manner, when the first signal indication value is in a different second relation to the second signal indication value.

4. The apparatus according to claim 1, wherein the apparatus furthermore comprises a signal indication computing unit being adapted to calculate the first signal indication value based on the first input channel, and being furthermore adapted to calculate the second signal indication value based on the second input channel.

5. The apparatus according to claim 1, wherein the manipulator is adapted to manipulate the combination signal, wherein the combination signal is generated according to the formula $$d(t)=a\cdot x_L(t)-b\cdot x_R(t),$$

wherein d(t) represents the combination signal, wherein $x_L(t)$ represents the first input channel, wherein $x_R(t)$ represents the second input channel and wherein a and b are steering parameters.

6. The apparatus according to claim 1, wherein the manipulator is adapted to manipulate the combination signal, wherein the combination signal represents a difference between the first and the second input channel.

7. The apparatus according to claim 1, wherein the apparatus furthermore comprises a transformer unit for transforming the first and the second input channel of the stereo input signal from a time domain into a frequency domain.

8. The apparatus according to claim 1, wherein the manipulation information generator is adapted to generate the first weighting mask depending on the first signal indication value, and to generate the second weighting mask depending on the second signal indication value; and wherein the manipulator is adapted to manipulate the combination signal by applying the first weighting mask to an amplitude value of the combination signal to acquire a first modified amplitude value, and to manipulate the combination signal by applying the second weighting mask to an amplitude value of the combination signal to acquire a second modified amplitude value.

9. The apparatus according to claim 8, wherein the apparatus furthermore comprises a combiner being adapted to combine the first modified amplitude value and a phase value of the combination signal to acquire the first manipulated signal as the first output channel; and wherein the combiner is adapted to combine the second modified amplitude value and a phase value of the combination signal to acquire the second manipulated signal as the second output channel.

10. The apparatus according to claim 8, wherein the manipulation information generator is adapted to generate the first weighting mask $G_L(m, k)$ according to the formula $$G_L(m, k) = \left(\frac{E_L(m, k)}{E_L(m, k) + E_R(m, k)}\right)^{\alpha}$$

or wherein the manipulation information generator is adapted to generate the second weighting mask $G_R(m, k)$ according to the formula $$G_R(m, k) = \left(\frac{E_R(m, k)}{E_L(m, k) + E_R(m, k)}\right)^{\alpha}$$

wherein $G_L(m, k)$ denotes the first weighting mask for a time-frequency bin (m, k), wherein $G_R(m,k)$ denotes the second weighting mask for a time-frequency bin (m,k), wherein $E_L(m,k)$ is a signal indication value of the first input channel for the time-frequency bin (m,k), wherein $E_R(m,k)$ is a signal indication value of the second input channel for the time-frequency bin (m,k) and wherein a is a tuning parameter.

11. The apparatus according to claim 10, wherein the manipulation information generator is adapted to generate the first or the second weighting mask, wherein the tuning parameter $\alpha$ is $\alpha=1$.

12. The apparatus according to claim 1, wherein the apparatus comprises a transformer unit and a combination signal generator;

wherein the transformer unit is adapted to receive the first and the second input channel and to transform the first and second input channel from a time domain into a frequency domain to acquire a first and a second frequency domain input channel;

and wherein the combination signal generator is adapted to generate a combination signal based on the first and the second frequency domain input channel.

13. The apparatus according to claim 1, wherein the apparatus further comprises a signal delay unit being adapted to delay the first input channel and/or the second input channel.

14. An upmixer for generating at least three output channels from at least two input channels comprising:

an apparatus for generating a stereo output signal according to claim 1 being arranged to receive two of the input channels of the upmixer as input channels; and a combining unit for combining at least two of the input signals of the upmixer to provide a combination channel;

wherein the upmixer is adapted to output the first output channel of the apparatus for generating a stereo output signal or a signal derived from the first output channel of the apparatus for generating a stereo output signal as a first output channel of the upmixer;

wherein the upmixer is adapted to output the second output channel of the apparatus for generating a stereo output signal or a signal derived from the second output channel of the apparatus for generating a stereo output signal as a second output channel of the upmixer; and wherein the upmixer is adapted to output the combination channel as a third output channel of the upmixer.

15. An apparatus for stereo-base widening for generating two output channels from two input channels, comprising:

an apparatus for generating a stereo output signal according to claim 1, being arranged to receive the two input channels of the apparatus for stereo-base widening as input channels; and a combining unit for combining at least one of the output channels of the apparatus for generating a stereo output signal with at least one of the input channels of the apparatus for stereo-base widening to provide a combination channel;

wherein the apparatus for stereo-base widening is adapted to output the combination channel or a signal derived from the combination channel.

16. A method for generating a stereo output signal comprising a first output channel and a second output channel from a stereo input comprising a first input channel and a second input channel comprising:

generating manipulation information depending on a first signal indication value of the first input channel and on a second signal indication value of the second input channel; wherein determining the manipulation information is conducted using the first signal indication value and using the second signal indication value for computing a first weighting mask; and wherein determining the manipulation information is conducted using the first signal indication value and using the second signal indication value for computing a second weighting mask, being different from the first weighting mask; and generating the first output channel by applying the first weighting mask on a combination signal, wherein the combination signal is a signal derived by combining the first input channel and the second input channel; and generating the second output channel by applying the second weighting mask on the combination signal, said combination signal being the combination signal on which the first weighting mask is applied to generate the first output channel.

17. An apparatus for encoding manipulation information, comprising:

a signal indication computing unit for determining a first signal indication value of a first channel of a stereo input signal and for determining a second signal indication value of a second channel of the stereo input signal;

a manipulation information generator being adapted to generate manipulation information depending on a first signal indication value of the first input channel and on a second signal indication value of the second input channel;

wherein the manipulation information generator is configured to determine the manipulation information using the first signal indication value and using the second signal indication value for computing a first weighting mask; and wherein the manipulation information generator is configured to determine the manipulation information using the first signal indication value and using the second signal indication value for computing a second weighting mask, being different from the first weighting mask; and an output module for outputting the manipulation information;

wherein the manipulation information is suitable for generating the first output channel by applying the first weighting mask on a combination signal, wherein the combination signal is a signal derived by combining the first input channel and the second input channel; and wherein the manipulation information is suitable for generating the second output channel by applying the second weighting mask on said combination signal.

18. A non-transitory computer-readable medium comprising a computer program for generating a stereo output signal comprising a first and a second output channel from a stereo input signal comprising a first input channel and a second input channel, implementing a method according to claim 16.

* * * * *